US006557830B2

(12) United States Patent
Sutter

(10) Patent No.: US 6,557,830 B2
(45) Date of Patent: May 6, 2003

(54) PREFABRICATED MASONRY FENCE SYSTEM AND METHOD FOR CONSTRUCTING SAME

(76) Inventor: Michael J. Sutter, 12336 W. Butler Dr., El Mirage, AZ (US) 85335

( * ) Notice: Subject to any disclaimer, the term of this patent is extended or adjusted under 35 U.S.C. 154(b) by 0 days.

(21) Appl. No.: 09/810,732

(22) Filed: Mar. 16, 2001

(65) Prior Publication Data

US 2001/0045551 A1 Nov. 29, 2001

Related U.S. Application Data

(60) Provisional application No. 60/190,468, filed on Mar. 17, 2000.

(51) Int. Cl.[7] ..... E04H 17/14

(52) U.S. Cl. ..... 256/19; 256/24

(58) Field of Search ..... 256/19, 62, 24–27, 256/65, 73, 1, 65.11; 52/125.1, 125.4, 125.2, 295, 233, 442, 565, 293.1, 293.2, 293.3, 284, 169.9, 761

(56) References Cited

U.S. PATENT DOCUMENTS

| | | | | | |
|---|---|---|---|---|---|
| 701,588 | A | | 6/1902 | Liebau | |
| 854,479 | A | | 5/1907 | Forster | |
| 1,012,868 | A | | 12/1911 | Laney | |
| 2,141,397 | A | | 12/1938 | Locke | |
| 2,365,397 | A | * | 12/1944 | Dickman | 256/65.11 |
| 2,573,195 | A | * | 10/1951 | Gunderson | 432/76 |
| 2,695,159 | A | | 11/1954 | Bridwell | |
| 3,298,668 | A | | 1/1967 | Schueren | |
| 3,512,759 | A | | 5/1970 | Resler | |
| 3,881,289 | A | * | 5/1975 | Mauroner | 52/259 |
| 3,902,702 | A | | 9/1975 | Kinnaman | |
| 4,569,167 | A | * | 2/1986 | Staples | 52/90 |
| 4,726,567 | A | * | 2/1988 | Greenberg | 256/19 |
| D305,154 | S | | 12/1989 | Muller et al. | |
| 5,501,057 | A | * | 3/1996 | Dawson | 52/761 |
| 5,623,797 | A | | 4/1997 | Gravier et al. | |
| 5,713,561 | A | | 2/1998 | Sugiyama | |
| D396,302 | S | | 7/1998 | Cziczeli | |
| 5,794,921 | A | * | 8/1998 | Greenberg | 256/19 |
| 5,836,572 | A | | 11/1998 | Sugiyama | |
| 5,893,254 | A | * | 4/1999 | Troiani et al. | 52/169.9 |

FOREIGN PATENT DOCUMENTS

| | | | | |
|---|---|---|---|---|
| AU | WO 96/00338 | | 1/1996 | |
| JP | 6-108705 | * | 4/1994 | 256/73 |

* cited by examiner

*Primary Examiner*—Lynne H. Browne
*Assistant Examiner*—Michael P. Ferguson
(74) *Attorney, Agent, or Firm*—Snell & Wilmer L.L.P.

(57) ABSTRACT

Masonry fence panel units are prefabricated, transported to the construction site and installed as modular units. Transport devices that facilitate transport and handling of the fence panel units at the manufacturing site and at the construction site are incorporated into the fence panel units. Masonry fence systems constructed of the fence panel units of the present invention are characterized by easier installation, easier removal, and lower cost than similar masonry fence systems built in situ.

9 Claims, 2 Drawing Sheets

PREFABRICATED MASONRY FENCE SYSTEM AND METHOD FOR CONSTRUCTING SAME

CROSS-REFERENCE TO RELATED APPLICATIONS

This application claims the priority of U.S. Provisional Application Ser. No. 60/190,468, filed Mar. 17, 2000, entitled "Prefabricated Masonry Fence System and Method for Constructing Same."

BACKGROUND OF THE INVENTION

1. Field of the Invention

The present invention relates to unit masonry fences and more particularly to masonry fence panels that are prefabricated, transported to the construction site and installed as modular units.

2. Background of the Invention

Masonry fencing—that is, fencing made from building bricks or blocks— is one of the oldest and most desirable types of fencing available to residential and commercial builders. Masonry fences are rugged, offer excellent noise attenuation, security, and privacy, are aesthetically pleasing and are very durable. The term "masonry unit" is used herein to refer to burnt clay bricks, concrete bricks, concrete blocks, and analogous structural elements used in masonry structures.

Traditionally, masonry fences have been built at the site where they are to be used. However, traditional methods for manufacturing masonry fences are quite labor intensive and time consuming, and have a variety of drawbacks. The usual method of erecting masonry fencing begins with the pouring of a suitable foundation, usually of concrete. Next, masonry components such as bricks and mortar are brought to the site and a skilled bricklayer is employed to ensure that the masonry units are laid in straight and even courses and that the finished fence exhibits adequate structural integrity.

Problems of the prior art construction systems for masonry fences are high labor costs, inconvenient in situ construction, difficult transport of fence panels, unremovable fence panels, and time consuming site preparation and construction. Although some prior art references exist that resolve one or more of these problems, a construction system for masonry fences that resolves all of these issues has yet to be disclosed. Most significantly, none of the prior art references provide for mechanisms or designs that enable ease of transport and removal of masonry fence units.

SUMMARY OF THE INVENTION

The present invention meets the above needs and achieves an advance in the field by providing a system and method for constructing a prefabricated masonry fence that results in substantial labor savings and costs savings over prior art methods, is easily transported and erected on site in prefabricated form, exhibits a high level of structural integrity, and is easily removable.

The present invention provides a masonry fence system that may be more conveniently constructed while nevertheless providing substantial structural integrity.

In accordance with one aspect of the present invention there will be provided a system and method for constructing a prefabricated masonry fence system that results in substantial labor savings and cost savings.

In accordance with yet a further aspect of the present invention, masonry fence systems constructed in accordance with the invention can be erected relatively quickly, as the units are prefabricated off site and then transported to the work site, where the units are easily erected in place and do not require labor-intensive laying of bricks and mortar.

In accordance with a further embodiment of the present invention, individual units of the prefabricated masonry fence system can be constructed using, for example, an assembly line approach and then transported to the construction site using special devices that are incorporated into the fence units during initial fabrication.

In accordance with yet a further aspect of the present invention, individual prefabricated units of fence systems constructed in accordance with the invention are easily removed for replacement, repair, and/or to clear barriers to further construction or enjoyment of the land on which they were previously erected.

BRIEF DESCRIPTION OF THE DRAWING

Additional aspects of the present invention will become evident upon reviewing the non-limiting embodiments described in the specification and the claims taken in conjunction with the accompanying drawing figures, wherein:

DETAILED DESCRIPTION OF THE DRAWING

The following descriptions are only of exemplary embodiments of the present invention, and are not intended to limit the scope, applicability, or configuration of the invention in any way. Rather, the following descriptions are intended to provide convenient illustrations for implementing different embodiments of the present invention. As will become apparent, various changes may be made in the function and arrangement of the elements described in these embodiments without departing from the spirit and scope of the invention.

Figure 2:
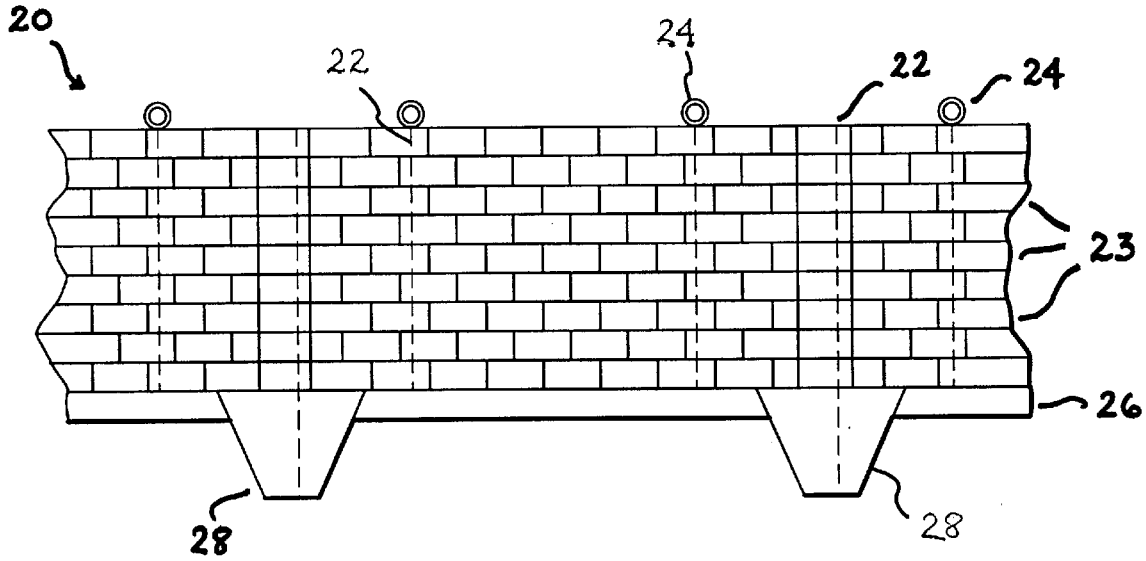
FIG. 2 is a front panel view of a section of a prefabricated masonry fence system constructed in accordance with one embodiment of the present invention.

A prefabricated masonry fence panel unit, such as unit 20 of FIG. 2, includes a plurality of courses 23 of masonry blocks mounted on a base support member 26. In accordance with one aspect of a preferred embodiment of the present invention, horizontal joints between adjacent courses are provided as mortared joints, while vertical joints between adjacent blocks are interlocking without mortar. Materials that can be used to construct these masonry fence units include, for example, burnt clay bricks, concrete bricks, concrete blocks and any other structural elements that may be used in masonry structures.

Figure 1:
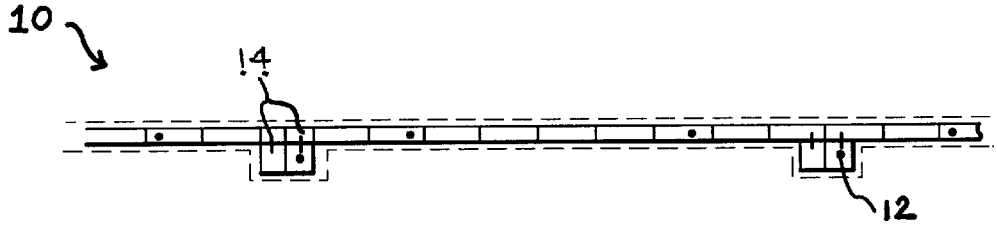
FIG. 1 is a top view of a section of a prefabricated masonry fence system constructed in accordance with one embodiment of the present invention.
Figure 3:
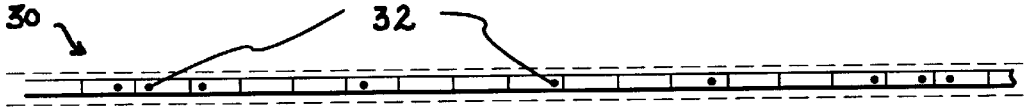
FIG. 3 is a top view of a section of a prefabricated masonry fence system constructed in accordance with a further embodiment of the present invention.

If structural strength beyond that exhibited by the masonry components themselves is needed, reinforcement devices 12, 32 such as threaded reinforcement bars and/or post-tensioning rods may be positioned at predetermined intervals throughout the fence panel units as shown in top view in FIGS. 1 and 3. In one aspect of a preferred embodiment of the invention, these reinforcement mechanisms may be embedded at one end in the footer (see FIG.

2) and extend upwardly through voids in the respective blocks or bricks. In the case of threaded reinforcement bar, voids in the blocks may be grouted or mortared to fill in the void and to add additional structural integrity to the fence. If post-tensioning rods are used, it is preferred that they not be embedded in the footer (see FIGS. 2 and 4), but rather extend from the lowest course of block upwardly through voids in the respective blocks to terminate in the highest or next-to-highest course of blocks. Alternatively, in the case of post-tensioning rods, the rods are post tensioned and the highest course of block may be mounted on top of the fence to enclose the top of the post-tensioning rods.

Figure 4:
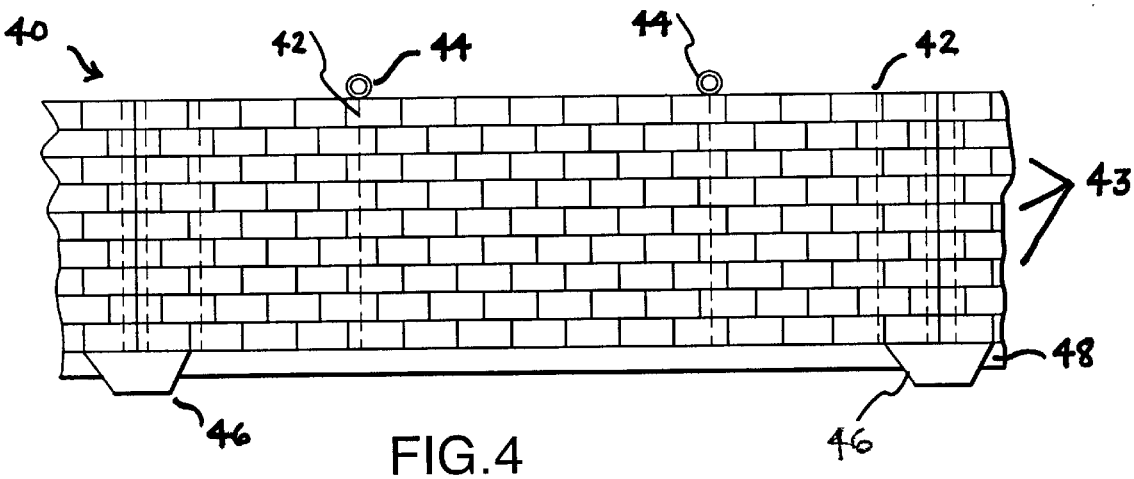
FIG. 4 is a front panel view of a section of a prefabricated masonry fence system constructed in accordance with a further embodiment of the present invention.

In a preferred embodiment, as shown in FIGS. 2 and 4, transport devices 24, 44, such as, for example, hooks, eye bolts, rings, loops, custom manufactured engagement devices, or the like, which may be used for lifting the individual fence units 20, 40, are attached to the top of the threaded reinforcement bars 22, 42 and/or to the top of post-tensioning rods extending through the panel. These devices enable easy transport of the individual fence units, such as, for example, by forklift or by crane to the bed of a flatbed truck or other transport vehicle for transport to a construction site. Once at the construction site, these devices provide for easy transport from the vehicle to the various areas of the construction site and also facilitate erection of the fence units. Preferably, transport devices 24 are positioned such that, upon lifting of the fence unit, a stable, relatively balanced load may be achieved. These transport-facilitating devices can be fashioned in any number of ways, and can even be custom-designed to work more effectively with particular types of construction equipment, such as forklifts and cranes.

The individual fence units may exhibit any dimensions that are suitable for the desired application. Generally, no limitations exist for the dimensions of the fence units other than practical considerations, such as, for example, weight, cost, ease of construction and transport, requirements of the general contractor, and preferences of the property owner. The thickness of the fence units may vary, depending on the desired application. For example, fence thicknesses of four inches, six inches and eight inches are considered common in the relevant art. There is no particular limit on the height of the units, although masonry fences of from about 4 to about 8 feet in height are common. The height of the fence may, however, be restricted by practical considerations, such as transport restrictions and weight requirements. The length of the individual units can vary, also, again depending on the desired application and other practical considerations. Length limitations may, for example, be implicated due to the capability of the forklifts, cranes, or other devices that may be used to transport and to erect the fence units.

In one aspect of a preferred embodiment of the invention, the use of post-tensioning rods in addition to or in substitution for threaded reinforcement bars, has the advantage that the weight of the grouting or concrete that is used in the voids of the masonry blocks is eliminated. Hence, use of post-tensioning rods may have the advantage of eliminating weight and therefore making construction easier. Further, once individual panels have been erected, the tops of the panels may be covered with caps. Preferably, the caps are fashioned so as to cover the joints between the individual units. These caps may be secured by any suitable means, such as by mortar or by mechanical affixation such as reinforcement rods, bolts, screws, and the like.

The spacing that exists between the threaded reinforcement bar columns and/or the tensioning rods may vary. Optionally, additional horizontal reinforcement mechanisms can be added between two or more of the masonry courses. For example, in a preferred embodiment of the present invention, a horizontal wire reinforcement may be positioned between the lowest course and the next to lowest course and again between the highest course and the next to highest course. For additional integrity and strength, horizontal wire reinforcements or other reinforcement devices may be positioned at other locations throughout the unit. Additionally, in accordance with the preferred aspect of the invention, wall ties 14 (see FIG. 1) may be installed to connect adjacent fence panel units or to connect fence panel units to external reinforcement structures.

In a preferred embodiment, a base supporting member provides structural strength to enable the fence panels to be transported and installed on site as modular units rather than having to be built in situ. Further, use of a base supporting member has the advantage of enabling fence units to be mounted on footings rather than requiring a fill foundation underlying all of the bottom masonry courses. As there can be considerably less effort required in pouring footings (see FIGS. 2 and 4) than in constructing a full foundation, there may be an attendant cost and time savings.

It is, of course, necessary to ensure that the dimensions of the base supporting member and the material of its construction are selected so as to provide adequate structural strength. Pre-cast concrete or pre-stressed or post-tension pre-cast concrete may be used for the supporting member.

In one aspect of a preferred embodiment of the invention, a prefabricated unit masonry fence panel is manufactured such that it has a pleasing appearance on both sides. This advantage may not be realized if the fence units were constructed on-site with only either the outside wall or the inside wall being finished according to the contractor's needs. In a preferred embodiment, the fence units may be pretreated, for example, sealed, stuccoed, painted, or the like, after fabrication and transported to the installation site in pre-finished form. This alternative embodiment presents numerous advantages, including greater uniformity, protection of uncured treatment products from inclement weather, temperature, or humidity conditions, and favorable cost savings due to mass-production ability and specialization of labor opportunities.

In accordance with one aspect of the present invention, a masonry fence system comprised of any number of masonry fence panel units prefabricated off-site in accordance with the above description is constructed by first preparing suitable footings for the fence panel units, typically by pouring footings in accordance with well-known techniques. Next, individual fence panel units are lifted and positioned into place on the footings using a lifting mechanism releasably engaged to transport devices integrated into the fence panel units in accordance with the above description. Once positioned into place, adjacent units may be reinforced and/or connected with wall ties to stabilize the fence system.

While the principles of the invention have been described in illustrative embodiments, it should be apparent that many modifications of structure, arrangement, proportions, elements, materials, and components used in the practice of the invention yet not specifically described herein, may be varied and particularly adapted for specific applications and operating requirements without departing from these principles.

I claim:

1. A prefabricated masonry fence panel unit comprising:

a base support member extending throughout at least a portion of the length of said fence panel unit;

a plurality of vertical started courses of masonry units positioned on said base support member;

a plurality of reinforcement devices extending substantially perpendicular to said base support member through at least two of said plurality of courses of masonry units; and a plurality of transport devices attached to said reinforcement devices for transporting said prefabricated fence panel unit.

2. The prefabricated masonry fence panel unit of claim 1 wherein said base support member extends throughout substantially the entire length of said fence panel unit.

3. The prefabricated masonry fence panel unit of claim 1 further comprising at least one horizontal reinforcement device positioned between at least two adjacent courses of said masonry units.

4. The prefabricated masonry fence panel unit of claim 1 wherein said transport devices are selected from the group consisting of hooks, eye bolts, rings, loops, and custom-manufactured engagement devices.

5. The prefabricated masonry fence panel unit of claim 1 wherein said reinforcement devices are selected from the group consisting of threaded reinforcement bars, post-tensioning rods, unthreaded reinforcement bars, rods, posts, and wires.

6. A prefabricated masonry fence system comprising:

a plurality of spaced apart footings, and at least one prefabricated fence panel unit positioned over and supported by said footings, said prefabricated fence panel unit comprising a base support member extending throughout at least a portion of the length of said fence panel unit, a plurality of vertically started courses of masonry units positioned on said base support member, a plurality of reinforcement devices extending substantially perpendicular to said base support member through at least two of said plurality of courses of masonry units, and a plurality of transport devices attached to said reinforcement devices for transporting said prefabricated fence panel unit.

7. The prefabricated masonry fence system of claim 6 further comprising a plurality of wall ties connected to and joining together adjacent prefabricated masonry fence panel units.

8. The prefabricated masonry fence system of claim 6 wherein said prefabricated masonry fence panel unit further comprises at least one horizontal reinforcement device positioned between at least two adjacent courses of said masonry units.

9. The prefabricated masonry fence system of claim 6 wherein said transport devices are selected from the group consisting of hooks, eye bolts, rings, loops, and custom-manufactured engagement devices.

* * * * *